United States Patent [19]

Torres

[11] Patent Number: 4,778,968

[45] Date of Patent: Oct. 18, 1988

[54] MICROWAVE OVEN LINER APPARATUS

[76] Inventor: Matthew A. Torres, 5835 Elmwood NE., Albuquerque, N. Mex. 87109

[21] Appl. No.: 130,123

[22] Filed: Dec. 8, 1987

[51] Int. Cl.[4] ..... H05B 6/80

[52] U.S. Cl. ..... 219/10.55 E; 219/10.55 R; 219/392; 126/39 M; 99/DIG. 14

[58] Field of Search ..... 219/10.55 E, 10.55 R, 219/10.55 M, 391, 392, 395; 126/39 M; 99/DIG. 14, 451

[56] References Cited

U.S. PATENT DOCUMENTS

| | | | |
|---|---|---|---|
| 2,888,542 | 5/1959 | Mork | 219/10.55 F |
| 2,912,559 | 11/1959 | Kirschke | 219/395 |
| 2,975,094 | 3/1961 | Anderson | 154/138 |
| 3,368,732 | 2/1968 | Kimble | 126/39 M |
| 4,117,199 | 9/1978 | Gotoh et al. | 428/486 |
| 4,326,006 | 4/1982 | Kaminstein | 428/204 |
| 4,343,978 | 8/1982 | Kubiatowicz | 219/10.55 E |
| 4,481,395 | 11/1984 | Smith et al. | 219/10.55 E |
| 4,603,069 | 7/1986 | Haq et al. | 428/76 |
| 4,603,077 | 7/1986 | Fujimoto et al. | 428/289 |
| 4,633,052 | 12/1986 | Beavers et al. | 219/10.55 E |

FOREIGN PATENT DOCUMENTS

| | | | |
|---|---|---|---|
| 1158792 | 7/1969 | United Kingdom | 126/39 M |

*Primary Examiner*—Philip H. Leung

*Attorney, Agent, or Firm*—Henderson & Sturm

[57] ABSTRACT

A microwave oven liner apparatus (10) for use in the cavity (101) of a microwave oven (100) wherein the liner apparatus (10) includes a generally box-like receptacle member (13) having a closure panel (17) and further provided with vent openings (20) and absorbent element (30) wherein the liner apparatus (10) is employed to keep the interior cavity (101) of the microwave oven (100) clean.

5 Claims, 1 Drawing Sheet

FIG. 1.
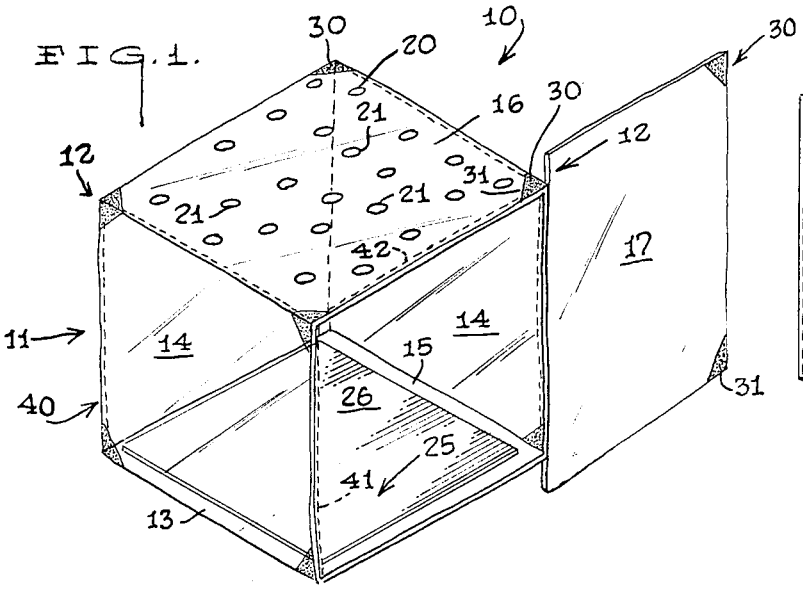
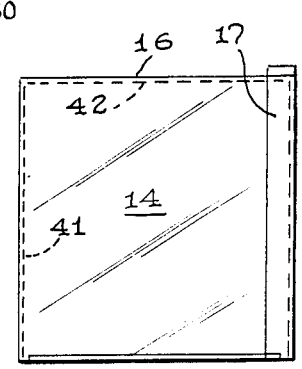
FIG. 2.
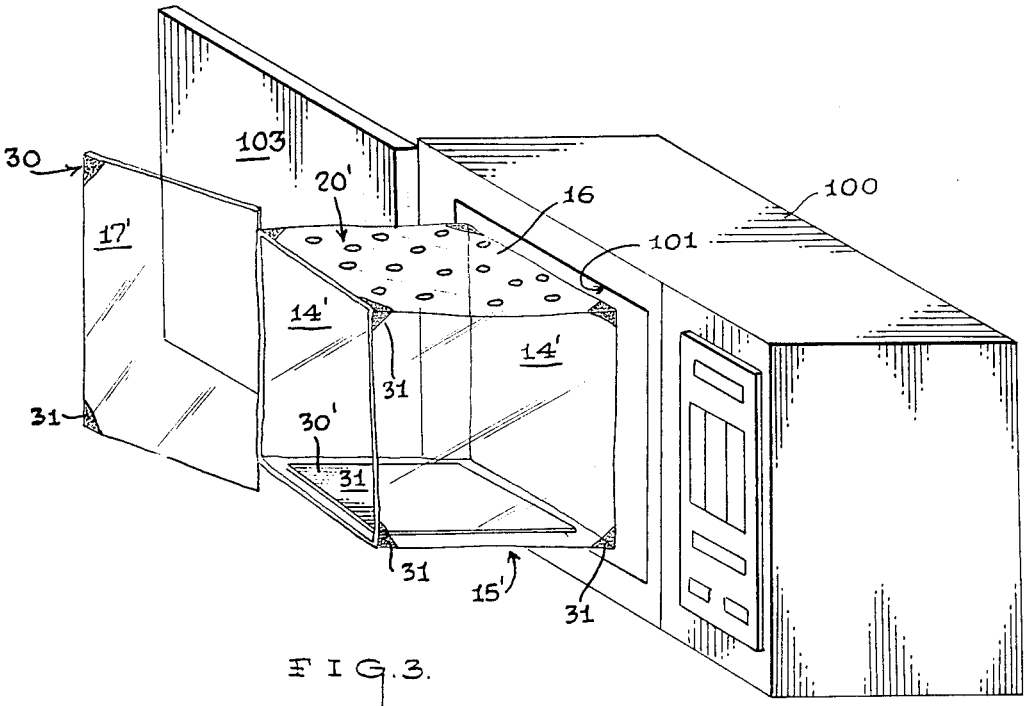
FIG. 3.

MICROWAVE OVEN LINER APPARATUS

TECHNICAL FIELD

The present invention relates generally to drip and splatter protectors for conventional cooking devices.

BACKGROUND OF THE INVENTION

This invention was the subject matter of Document Disclosure Program No. 159513 filed in the U.S. Patent and Trademark Office on Nov. 18, 1986.

With the advent of the microwave oven, consumers in this country have been faced with the challenge of trying to adapt to an entirely different manner of preparing foods from the traditional cooking methods employed with a conventional stove or oven.

While the microwave oven has been heralded as a modern day miracle relative to the time that is saved by using this device, the consumer has also been faced with a new set of problems associated with the relatively new and unique requirements regarding the use of the apparatus.

One of the aforementioned problems relates to the prohibition against using metal containers in the oven; another problem is associated with the need to place absorbent material under and/or over certain foodstuffs while cooking; yet another problem relates to the fact that certain foodstuffs must be placed in a covered dish during cooking; and still another problem is related to the fact that the inside of the microwave oven must be periodically cleaned for health and sanitary reasons.

Based on the foregoing situation there has recently existed a deeply felt need for an apparatus that would address some of the aforementioned problems, and further enhance the consumers growing acceptance of the microwave oven by simplifying and/or eliminating some of the more onerous aspects surrounding its use.

SUMMARY OF THE INVENTION

Briefly stated, the apparatus that forms the basis of the present invention involves a microwave oven liner apparatus that includes a liner unit dimensioned to conform to the interior surfaces of the microwave oven cavity and a support unit that is adapted to maintain the inner unit in an adjoining relationship with the surfaces that define the cavity.

In addition, the liner unit is provided with a releasable closure means that permits the insertion of food and food containers into the interior of the receptacle that is defined by the liner unit. The liner unit is further provided with vent means to permit air circulation through the liner unit, and an absorbent member on the bottom interior surface of the liner unit to absorb spills or overflowing liquids from the food containers placed within the liner unit.

Both the liner unit and the support unit are fabricated from material that is impervious to the effects of the microwave radiation, and this invention further contemplates making the liner unit either of relatively inexpensive thin sheet material, such that the liner unit may be a disposable item or in the alternative, the liner unit may be formed from a more rigid material wherein the liner unit is not only washable but also does not require the assistance of the support unit to maintain its desired configuration.

It should also be apparent that by using the microwave oven liner of this invention, the job of keeping the oven cavity clean is greatly simplified due to the fact that the only surfaces of the cavity that can potentially become soiled are those surfaces that are in close proximity to the vent means of the liner unit.

BRIEF DESCRIPTION OF THE DRAWINGS

These and other objects, advantages, and novel features of the invention will become apparent from the detailed description of the best mode for carrying out the preferred embodiment of this invention which follows, particularly when considered in conjunction with the accompanying drawings wherein:

FIG. 1 is a perspective view of the preferred embodiment of the microwave oven liner apparatus of this invention;

FIG. 2 is a side plan view of this embodiment; and,

FIG. 3 is a perspective view of another embodiment of the microwave oven liner apparatus of this invention.

BEST MODE FOR CARRYING OUT THE INVENTION

As can be seen by reference to the drawings and in particular to FIG. 1, the microwave oven liner apparatus that forms the basis of the present invention is designated generally by reference numeral (10). The microwave oven liner apparatus (10) comprises in general a liner unit (11) and a support unit (12). These units will now be described in seriatim fashion.

In the preferred embodiment of this invention depicted in FIGS. 1 and 2, the liner unit (11) comprises a flexible receptacle member (13) having three vertical wall panels (14) a floor panel (15) a top panel (16) and a hinged closure panel (17); wherein, with the exception of the hinged closure panel (17) which is only integrally connected to another panel (14) along one edge, all of the remaining panels are integrally connected to one another along three common edges.

In addition, the liner unit (11) is further provided with vent means (20) and an absorbent member (25) wherein the vent means (20) comprises a plurality of apertures (21) provided in one or more of the panels to permit air flow through the receptacle defined by the panels when the closure panel (17) is deployed in the closed mode; and, wherein the absorbent member (25) comprises a sheet (26) of absorbent material such as a paper towel or the like.

As can best be appreciated by reference to FIG. 1, the hinged closure panel (17) which is operatively associated with the microwave oven door ((103) and has a generally rectangular configuration that is dimensioned such that it will extend beyond the periphery of the edges of the side (14) and top (16) panels that it will contact when deployed in the closed mode, as will be explained further on in the specification.

In as much as the liner unit (11) of the preferred embodiment is fabricated from a very thin, heat resistant flexible material such as a self-clinging plastic wrap or the like, the liner unit is not self supporting and will require a support unit (12) in order to assume and maintain the generally rectangular box-like configuration depicted in FIGS. 1 and 2.

In the preferred embodiment of this invention illustrated in FIGS. 1 and 2, the support unit (12) comprises a plurality of releasable securing means (30) that are operatively associated with the interior walls of the oven cavity (101) as well as the interior of the oven door (103). As shown in FIGS. 1 and 2, the releasable securing means (30) comprise a plurality of relatively discrete adhesive elements (31) that are operatively connected to the side (14) and top (16) panels of the liner unit (11) to suspend and secure the liner unit (11) in a generally rectangular configuration; wherein, the adhesive elements (31) are disposed intermediate the liner unit (11) and the walls of the microwave cavity (101).

In addition, the free end of the closure panel (17) of the liner unit (11) is also provided with at least one adhesive element (31) that operatively connects the closure panel (17) to the microwave oven door (103); wherein, the closure panel (17) will open and close the interior of the liner unit (11) in response to the movement of the oven door (103).

In an alternate version of the preferred embodiment illustrated in FIG. 1, the support unit (12) comprises a generally rigid framework member (40) having four vertical leg segments (41) shown in phantom in FIGS. 1 and 2, that are interconnected with one another on their upper ends by a minimum of three horizontal leg segments (42). It being understood that while additional horizontal leg segments may be employed to give further rigidity and support to the flaccid liner unit (11) it is only necessary to provide four corner support to the receptacle member (13) coupled with lateral support along the top and both sides adjacent the upper portion of the receptacle opening (18). While the four corner support is required to maintain the box-like configuration of the receptacle member, the lateral support proximate the upper portion of the receptacle opening (18″) tensions the flexible fabric of the receptacle member such that the projecting edges of the closure panel (17) will rest on, and frictionally engage, the top (16) and two of the side panels (14) of the receptacle member (13) to effect the closure thereof as depicted in FIG. 2.

At this juncture it should be appreciated that the liner unit (11) of the preferred embodiment is intended to be a disposable item that will be employed a limited number of times and then replaced by a fresh liner unit (11). In as much as the liner unit (11) of the preferred embodiment is capable of mass production and is fabricated from a flaccid material, it is envisioned that a plurality of the disposable liner units (11) will be packaged in a compact dispensing box (not shown) similar to those employed for dispensing plastic trash bags and like constructed items.

It should also be appreciated at this juncture that the framework member (40) of the support unit (12) is fabricated from more durable long lasting material such as wood, plastic, or ceramics that are not affected by the microwave radiation. In addition, the framework member (40) is dimensioned to closely approximate the dimensions of the cavity (101) of the microwave oven (100); wherein, the receptacle member (13) will be supported in close proximity to, but spaced from, the interior walls that devine the cavity (101). This particular dimensioning will further insure that air will circulate freely thru the vent means (20) of the receptacle member (13) and the cavity (101).

In another alternate embodiment of this invention illustrated in FIG. 3, the liner unit (11) comprises a generally rigid box-like receptacle member (13′) having three vertical panels (14′) a bottom panel (15′) a top panel (16′) and a hinged closure panel (17′) wherein one of the panels is provided with vent means (20) and the bottom panel is provided with a removable absorbent means (30).

Basically the only structural distinctions that exist between the receptacle member (13) of the preferred embodiment and the receptacle member (13′) of the alternate embodiment involve the self supporting nature of the alternate receptacle member (13′) coupled with the fact that the hinged closure panel (17′) is dimensioned such that it will not extend substantially beyond the receptacle member opening (18′) as defined by the integrally formed panels; and, the hinged closure panel (17′) is also provided with at least one releasable securing means (30) that is operatively associated with the oven door (103).

It should also be appreciated that the material from which the alternate receptacle member (13′) is fabricated should also be dishwasher safe in addition to being impervious to microwave radiation. It should further be appreciated that both the alternate (13′) and preferred (13) embodiments of the receptacle member function the same with regard to keeping the interior of the microwave oven cavity (101) clean by preventing spilled and splattered foodstuffs from coming into contact with the interior walls of the microwave oven (100). The only basic functional difference between these two embodiments being the fact that one of them is disposable and the other is reusable.

Having thereby described the subject matter of this invention, it should be obvious that many substitutions, modifications, and variations of the invention are possible in light of the above teachings. It is therefore to be understood that the invention as taught and described herein is only to be limited to the extent of the breadth and scope of the appended claims.

I claim:

1. A microwave oven having an oven door and an oven cavity defined by the interior walls of the oven for use in combination with a microwave oven liner apparatus for preventing foodstuffs from contacting the interior walls of the oven cavity; wherein, the microwave oven liner apparatus comprises;

a liner unit comprising generally box-like flaccid receptacle member having; vertical wall panels; a bottom panel; a top panel; and a hinged closure panel operatively attached to a selected one of the vertical wall panels; wherein, the generally box-like flaccid receptacle member is provided with a receptacle opening that is defined by the top panel; the bottom panel; and selected ones of the vertical wall panels; wherein, the hinged closure panel is dimensioned to completely cover the receptacle opening, and further provided with at least one adhesive member that is adapted to adhesively secure the hinged closure panel to the interior of the microwave oven door; such that the hinged closure panel will open and close the receptacle opening in reponse to the movement of the oven door.

2. The microwave liner apparatus as in claim 1 wherein the said bottom panel is further provided with absorbent means for collecting drippings from the foodstuffs that are cooked within the microwave oven.

3. The microwave liner apparatus as in claim 2 wherein the receptacle member is further provided with vent means associated with at least one of said panels; whereby the interior of the receptacle member may be vented during the cooking process.

4. The microwave liner apparatus as in claim 3 wherein the receptacle member is further provided with a plurality of adhesive members disposed intermediate the said liner unit and the interior walls of the oven cavity.

5. The microwave liner apparatus as in claim 1 wherein the hinged closure panel is formed integrally with said selected one of the vertical wall panels.

* * * * *